US008725021B2

(12) United States Patent
Matsuda et al.

(10) Patent No.: US 8,725,021 B2
(45) Date of Patent: May 13, 2014

(54) IMAGE FORMING APPARATUS WITH CONTROLLED DEVELOPER REMOVAL

(75) Inventors: Kohei Matsuda, Fujisawa (JP); Hideaki Hasegawa, Suntou-gun (JP); Hirokazu Fujino, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 298 days.

(21) Appl. No.: 13/267,240

(22) Filed: Oct. 6, 2011

(65) Prior Publication Data

US 2012/0087685 A1 Apr. 12, 2012

(30) Foreign Application Priority Data

Oct. 8, 2010 (JP) ..... 2010-228686
Sep. 7, 2011 (JP) ..... 2011-195387

(51) Int. Cl.
*G03G 15/00* (2006.01)

(52) U.S. Cl.
USPC ..... 399/71

(58) Field of Classification Search
USPC ..... 399/71, 349, 350, 101
See application file for complete search history.

(56) References Cited

U.S. PATENT DOCUMENTS

2009/0245904 A1* 10/2009 Maruyama ..... 399/350

FOREIGN PATENT DOCUMENTS

JP 09305077 A * 11/1997
JP 2006-293141 A 10/2006

* cited by examiner

*Primary Examiner* — Susan Lee
(74) *Attorney, Agent, or Firm* — Fitzpatrick, Cella, Harper & Scinto

(57) ABSTRACT

An image forming apparatus includes an image bearing member for carrying a developed image, a developer carrying member for carrying a developer to be supplied to the image bearing member, a cleaning blade for removing the developer from the image bearing member, and a controller for executing, at predetermined timing during a non-image-formation period, sequence controls for moving developer to the image bearing member and removing developer from the image bearing member by the cleaning blade. In addition, a removing unit removes the developer at a position before the developer, moved to the image bearing member by the sequence control, reaches the cleaning blade. An amount of the developer removed by the cleaning blade is controlled to be smaller in a first sequence control than in a second sequence control.

4 Claims, 4 Drawing Sheets

IMAGE FORMING APPARATUS WITH CONTROLLED DEVELOPER REMOVAL

FIELD OF THE INVENTION AND RELATED ART

The present invention relates to an image forming apparatus such as a copying machine, a printer, and the like. That is, it relates to an apparatus capable of forming an image on a recording medium such as a sheet of paper.

There are instances when the toner (developer) in the developing device of an electrophotographic image forming apparatus is not used for a while, or when a substantial number of images, each of which is relatively small in the amount by which toner is consumed for its formation, are continuously formed. In these cases, the length of time the unused toner remains unattended in a developing device and/or on the peripheral surface of a development roller becomes substantial, causing thereby the unused toner in a developing device and/or the peripheral surface of the development roller to change in electrical properties or the like. As the toner in the developing device, and/or on the peripheral surface of the photosensitive drum, of an electrophotographic image forming apparatus changes in electrical properties or the like, the image forming apparatus is likely to output images which are low in quality. In particular, in a case where a substantial number of images, each of which is relatively small in the amount by which toner is consumed for its formation, are continuously formed, it is possible that the toner in the developing device increases in electric charge. This is problematic because if the toner in the developing device of an electrophotographic image forming apparatus increases in electric charge beyond a certain level, the apparatus is likely to output images which are insufficient in density.

Further, in the case of a printing job for outputting only a few images (prints), for example, one or two images (prints), the length of the sum of the pre-rotation and post-rotation of a photosensitive drum is higher in its ratio relative to the overall length of the print job. That is, the length of time a photosensitive drum is rotated while virtually no residual toner is recovered by a cleaning blade is higher in its ratio relative to the overall length of the printing job. Thus, if a substantial number of printing jobs which are very small in print count are consecutively carried out by an electrophotographic image forming apparatus, the apparatus drastically reduces in the lubricity between its cleaning blade and photosensitive drum. The drastic reduction in the lubricity between the cleaning blade and photosensitive drum is likely to cause the cleaning blade to buckle. With the buckling of the cleaning blade, it is possible for the image forming apparatus to output defective images.

Further, when a substantial number of prints, each of which requires only a small amount of toner consumption, are continuously outputted, the amount by which toner is recovered by a cleaning blade, that is, the amount by which toner remains on the peripheral surface of a photosensitive drum after the primary transfer, is small. Therefore, the cleaning blade reduces in its lubricity relative to a photosensitive drum. However, the cleaning blade continuously recovers the transfer residual toner although by only a small amount. Therefore, the cleaning blade remains lubricated relative to the photosensitive drum to a certain degree. Nonetheless, there is no doubt about the fact that the cleaning blade is reduced in lubricity relative to a photosensitive drum. Thus, if an electrophotographic image forming apparatus continues to be operated under this kind of condition, it is possible for its cleaning blade to buckle.

One of the solutions to the above-described problem is disclosed in Japanese Laid-open Patent Application 2,006-293141. According to this patent application, an electrophotographic image forming apparatus is periodically operated in a "toner discharge mode", that is, a mode in which a solid rectangular image which corresponds in size to the entirety of the development roller is formed on the peripheral surface of the photosensitive drum, and then, is recovered by the cleaning blade. Thus, the toner in the developing device is rejuvenated, and the toner on the peripheral surface of the development roller is completely replaced, and also, it is ensured that the cleaning blade is kept properly lubricated. Therefore, the cleaning blade is prevented from being buckled. Therefore, the electrophotographic image forming apparatus is prevented from outputting low quality images.

The toner discharge sequence carried out by the electrophotographic image forming apparatus when the apparatus is in the "toner discharge mode" is as follows: First, in order to highly effectively rejuvenate the toner in the developing device, a solid rectangular toner image which corresponds in size and shape to the entirety of the peripheral surface of the development roller is formed on the peripheral surface of the photosensitive drum by transferring all the toner on the development roller, onto the peripheral surface of the photosensitive drum. Then, in order to ensure that the cleaning blade is properly lubricated, the solid rectangular toner image on the photosensitive drum is recovered by the cleaning blade without going through the primary transfer step. As described above, a printing job which is very small in print count is large, in terms of the ratio of the sum of the pre-rotation and post-rotation, that is, the ratio of the length of time when only the photosensitive drum is rotated, relative to the overall length of the printing job. Therefore, there is very little residual toner to be recovered by the cleaning blade. Therefore, as the means for ensuring that the cleaning blade is kept properly lubricated when a substantial number of printing jobs, each of which is very small in print count, are continuously carried out, it is effective to form a solid rectangular toner image which corresponds in size and shape to the entirety of the peripheral surface of the development roller, on the peripheral surface of the photosensitive drum, and then, causing the cleaning blade to recover the solid rectangular toner image, without transferring the solid rectangular toner image away from the peripheral surface of the photosensitive drum.

The above-described sequence for rejuvenating the developer in the developing device and replacing the toner on the development roller is carried out as necessary based on a preset image formation count, the cumulative length of the rotation of the development roller in the developing device, the cumulative number of rotations of the development roller, or the like.

The toner discharge sequence described above sometimes suffers from the following problems:

Normally, the toner discharge sequence is independently carried out from the ordinary image forming operation. That is, as the cumulative image formation count, cumulative length of development roller rotation, cumulative number of development roller rotations, or the like, reaches a preset value, the toner discharge sequence is automatically carried out. More specifically, as one of the above-mentioned parameters reaches a preset value, the on-going image forming operation is interrupted after the image which was being formed is completed. Then, the toner discharge sequence is carried out. Then, as soon as the sequence is completed, the interrupted image forming operation is restarted. Thus, carrying out the toner discharge sequence during a continuous printing job adds to the downtime, that is, the time spent for an operation other than actual printing operation. In other words, it necessitates additional time to finish the continuous printing job. Here, "downtime" means a period in which an image forming apparatus cannot form an image even though it is "on".

Further, as a continuous printing job is interrupted to carry out the toner discharge sequence, and the toner discharge sequence is carried out immediately after the image which was being formed is completed, a substantially larger amount of toner reaches the cleaning blade than before the continuous printing job was interrupted, because the solid rectangular toner image formed on the peripheral surface of the photosensitive drum reaches the cleaning blade without being put through the primary transfer process.

Thus, it is ensured that the cleaning blade is fully lubricated. However, a large mount of toner temporarily collects on the cleaning edge portion of the cleaning blade. Therefore, it is possible for a substantial amount of toner to slip by the cleaning blade. Therefore, immediately after an electrophotographic image forming apparatus is put through the toner discharge sequence, it is likely to output defective images, that is, images which suffer from unwanted fine streaks which are attributable to the toner having slipped by the cleaning blade, and are parallel to the rotational direction of the photosensitive drum.

As a means for preventing the formation of the above described defective image, it is effective to extend the interval between the completion of the toner discharge sequence and the starting of the next image formation sequence to extend the length of time the photosensitive drum can be rotated during the interval in order to increase the opportunities for recovering the toner on the peripheral surface of the photosensitive drum having slipped by the cleaning blade. However, extending the length of time the photosensitive drum is rotated between the completion of the toner discharge sequence and the starting of the next image formation sequence adds to the "downtime".

Further, as a means for preventing the formation of the above described defective image, it is also effective to reduce the amount by which toner is discharged in the toner discharge sequence, and one of the methods to reduce the amount by which toner is discharged in the toner discharge sequence is to change the dimension (in terms of rotational direction of photosensitive drum) in which the solid rectangular toner image is formed on the peripheral surface of the photosensitive drum. However, if the amount by which toner is discharged in the toner discharge sequence is reduced, it is not ensured that the toner in the developing device is satisfactorily rejuvenated, and the toner on the peripheral surface of the development roller is fully replaced. Therefore, it is possible that the image forming apparatus will output images of low quality.

Further, as a means for rejuvenating the toner in the developing device and replacing the toner on the peripheral surface of the development roller without creating the above described problem, it is possible to reduce the amount by which toner is discharged per toner discharge sequence, and increase the number of times the toner discharge sequence is carried out. This method adds to the number of the occurrence of "downtime", adding thereby to the overall length of "downtime".

SUMMARY OF THE INVENTION

The present invention was made in consideration of the issues described above, and the like. Thus, the primary object of the present invention is to ensure that the cleaning blade of an electrophotographic image forming apparatus is well lubricated, and also, the developer in the developing device in the image forming apparatus is rejuvenated as necessary, in order to prevent the image forming apparatus from reducing image quality.

According to an aspect of the present invention, there is provided an image forming apparatus comprising a image bearing member for carrying a developed image; a developer carrying member for carrying a developer to be supplied to said image bearing member; a cleaning blade for removing the developer from said image bearing member; control means for executing, at predetermined timing during non-image-formation period, sequence controls for moving a developer from said developer carrying member to said image bearing member and removing a developer moved to said image bearing member by said cleaning blade; removing means capable of removing the developer in a position before a developer moved to said image bearing member by-the sequence control reaches said cleaning blade; wherein said sequence controls includes a first sequence control and a second sequence control, and when image forming operation is continuously carried out on a predetermined number or more of recording materials, and the predetermined timing comes in a state that there still remains the recording material on which the image forming operation is to be effected, said control means effects a first sequence control, and wherein when the predetermined timing comes in a state that there does not remain the recording material on which the image forming operation is to be effected, said control means effects a second sequence control, and wherein a amount of the developer removed by said cleaning blade is controlled such that the amount is smaller in the first sequence control than in the second sequence control.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention are described in detail with reference to the appended drawings. The measurements, materials, shapes, and positioning of the structural components of the image forming apparatus in each of the following embodiments of the present invention are to be modified as necessary, according to the structure of an apparatus to which the present invention is applied, and also, the various conditions under which the apparatus is operated. In other words, these embodiments are not intended to limit the present invention in scope.

The present invention relates to an electrophotographic image forming apparatus. More specifically, it relates to an image forming apparatus which forms an electrostatic latent image on its image bearing member, with the use of an electrophotographic image formation method, and develops the electrostatic latent image into a visible image with the use of the developer (toner) in its developing device. It relates to also an image forming apparatus which is designed as described above, and employs a process cartridge removably mountable in its main assembly. Examples of an electrophotographic image forming apparatus include a copying machine, a laser beam printer, an LED printer, a facsimile machine, and the like.

The present invention relates to the toner discharge sequence carried out by an electrophotographic image forming apparatus during a continuous printing job in order to rejuvenate the toner in the developing apparatus, and also, to replace the toner on the peripheral surface of the development roller. The characteristic feature of the toner discharge sequence in accordance with the present invention is that the amount by which toner is recovered by the cleaning blade is controlled while the amount by which toner is moved out of the developing device is kept unchanged. Therefore, not only can the present invention prevent the problem that as a continuous printing job progresses, an electrophotographic image is likely to reduce in image quality, but also, it can ensure that the cleaning blade remains properly lubricated. Therefore, the present invention can prevent an electrophotographic image forming apparatus from outputting defective images, more specifically, the images suffering from unwanted fine streaks which are parallel to the rotational direction of the photosensitive drum and are attributable to the buckling of the cleaning blade and/or toner having slipped by the cleaning blade.

Embodiment 1

Figure 1:
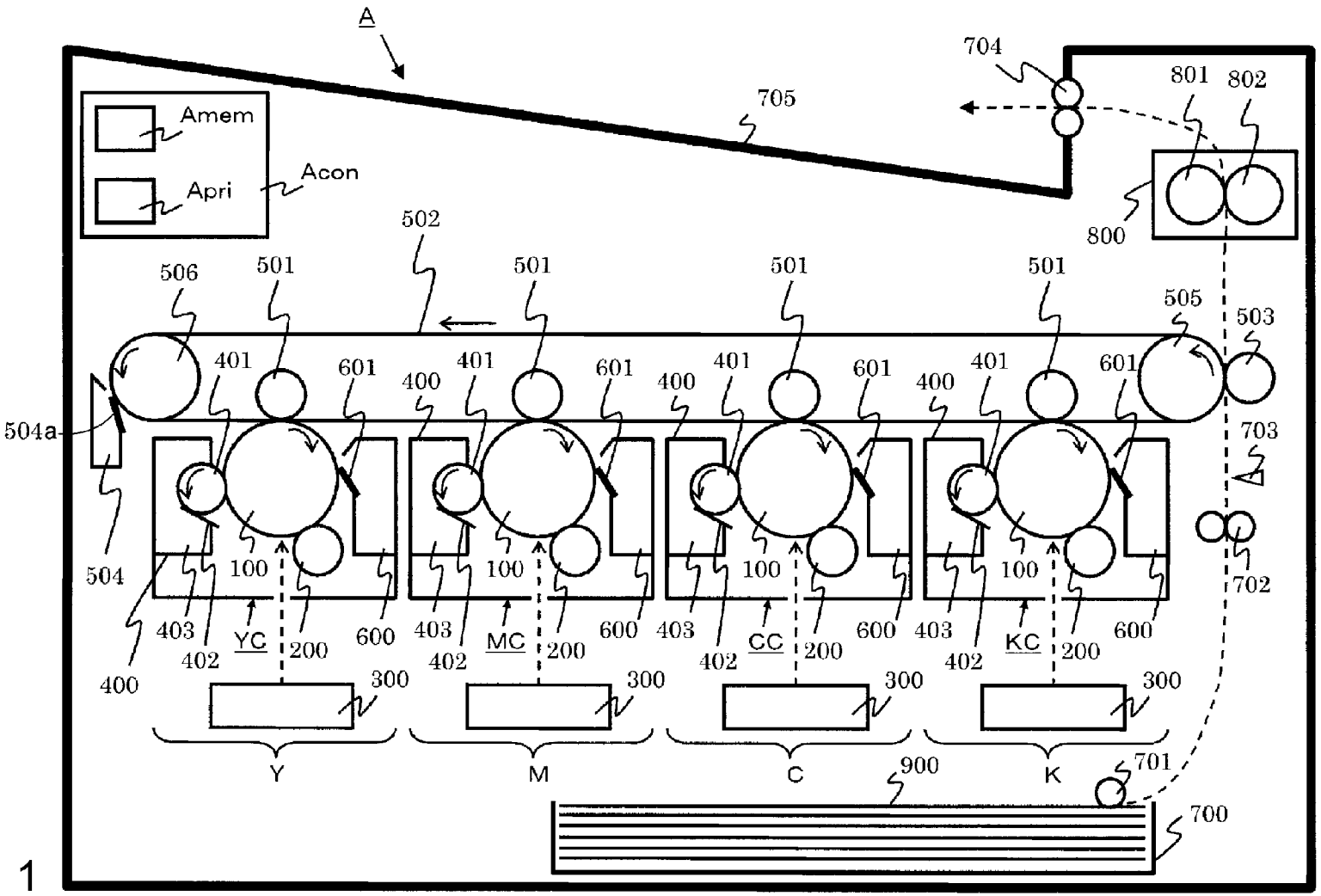
FIG. 1 is a schematic sectional view of the image forming apparatus in the first preferred embodiment of the present invention, and shows the general structure of the apparatus.

FIG. 1 is a schematic sectional view of the image forming apparatus A in this embodiment, and shows the general structure of the apparatus A. First, an image forming apparatus A, which is in accordance with the present invention, is described.

(Image Forming Apparatus)

The image forming apparatus A is a full-color image forming apparatus of the so-called tandem type. It has an intermediary transfer belt 502 as an intermediary transfer member of the apparatus A. The belt 502 is an endless belt. It is wrapped around a pair of rollers 505 and 506, being thereby supported by the pair of rollers 505 and 506. The roller 505 is the driver roller. The belt 502 is rotatable in the counterclockwise direction (indicated by arrow mark) of FIG. 1, by the driver roller 505 which is driven by a belt driving section (unshown). The apparatus A is also provided with a cleaning apparatus 504, which has a cleaning member (first cleaning member) 504*a* for removing the secondary transfer residual toner, and the like, on the intermediary transfer belt 502. The cleaning apparatus 504 is positioned so that its cleaning member 504*a* is in contact with the portion of the intermediary transfer belt 502, which is in contact with the peripheral surface of the roller 506.

The image forming apparatus A has also a second transfer roller 503, which is in contact with the portion of the intermediary transfer belt 502, which is in contact with the peripheral surface of the driver roller 505. The surface layer of the second transfer 503 is formed of an elastic substance. Thus, as the second transfer roller 503 is pressed against the driver roller 505, a nip is formed between the second transfer roller 503 and intermediary transfer belt 502. The second transfer roller 503 is rotated by the circular movement of the intermediary transfer belt 502 and the movement of a sheet 900 of recording medium through the nip.

To the second transfer roller 503, a secondary transfer bias is applied from a secondary transfer bias power source (unshown). The image forming apparatus A is structured so that the secondary transfer roller 503 can be placed in contact with, or separated from the intermediary transfer belt 502, by a driving section (unshown) with a preset timing to prevent the second transfer roller 503 from interfering with an image forming operation and the operations related thereto.

There is a pair of timing rollers 702 and a timing sensor 703 below the second transfer roller 503. Further, there is a cassette 700 below the timing sensor 703. More specifically, the cassette 700 is in the bottom portion of the main assembly of the image forming apparatus A, and is removably mountable in the main assembly. The cassette 700 stores multiple sheets 900 of recording medium in layers. Each of the sheets 900 in the cassette 700 is pulled out of the cassette 700 by a recording medium feeding roller 701 (recording medium feeding/conveying roller) while being separated from the rest, and then, is conveyed to a pair of timing rollers 702. Incidentally, this image forming apparatus A is compatible with ordinary paper, glossy paper, OHP sheet, and the like.

Further, the image forming apparatus A has a fixing device 800, which is above the second transfer roller 503. The fixing device 800 has a fixation roller 801 and a pressure roller 802. The fixation roller 801 is heated by a halogen heater (unshown) in the fixation roller 801. The pressure roller 802 is kept pressed upon the fixation roller 801. The fixing device 800 is for permanently fixing the toner image on a sheet 900 of recording medium to the sheet 100 after the transfer (secondary transfer) of the toner image to the sheet 900.

Further, there is a pair of discharge rollers 704 and a delivery tray 705 on the downstream side of the fixing device 800 in terms of the rotational direction of the photosensitive drum.

Further, the image forming apparatus A is provided with yellow, magenta, cyan, and black image forming stations. In terms of the moving direction of the intermediary transfer belt 502, the four image forming stations are between the driver roller 505 and opposite roller 506, around which the intermediary transfer belt 502 is wrapped. The four image forming stations are sequentially aligned in tandem in the listed order, in the moving direction of the intermediary transfer belt 502, and are in contact with the intermediary transfer belt 502. Each of the yellow, magenta, cyan, and black image forming stations Y, M, C, and K, respectively, has a photosensitive drum 100, which is rotatable. The photosensitive drum 100 is a member on which an electrophotographic latent image is formed.

Each image forming station has a charging device 200, an exposing device 300, a developing device 400, a primary transfer roller 501, and a cleaning device 600, which are in the adjacencies of the peripheral surface of the photosensitive drum 100 and are in the listed order. The cleaning device 600 is for cleaning the peripheral surface of the photosensitive drum 100 by removing the toner and the like contaminants remaining on the peripheral surface of the photosensitive drum 100 after the transfer (primary transfer) of a toner image from the peripheral surface of the photosensitive drum 100. The charging device 200 is for uniformly charging the peripheral surface of the photosensitive drum 100. The exposing device 300 is for forming an electrostatic latent image on the uniformly charged portion of the peripheral surface of the photosensitive drum 100. The developing device 400 is a developing means. It is for developing the electrostatic latent image formed on the peripheral surface of the photosensitive drum 100 (image bearing member), into a visible image (toner image, that is, image formed of toner) with the use of toner (developer). The primary transfer roller 501 is a transferring means. It is for transferring (primary transfer) the toner image (visible image) on the peripheral surface of the photosensitive drum 100 formed by the developing device 400 on the peripheral surface of the photosensitive drum 100, onto the intermediary transfer belt 502.

The photosensitive drum 100, charging device 200, developing device 400, and cleaning device 600 for each image forming station are integrated in the form of a process cartridge which is removably mountable in the main assembly of the image forming apparatus A.

That is, the yellow image forming station Y comprises the yellow process cartridge YC, and the magenta image forming station M comprises the magenta process cartridge MC. Further, the cyan and black image forming stations C and K comprise cyan and black process cartridges CC and KC, respectively.

Referring to FIG. 1, the primary transfer roller 501 of each image forming station is kept pressed against the photosensitive drum 100 of the same image forming station, with the presence of the intermediary transfer belt 502 between itself and photosensitive drum 100. It is rotated by the circular movement of the intermediary transfer belt 502. To the primary transfer roller 501, a primary transfer bias (voltage) for transferring (primary transfer) the toner image on the peripheral surface of the photosensitive drum 100 onto the intermediary transfer belt 502 is applied from a primary transfer bias power source (voltage applying means; unshown).

In this embodiment, the photosensitive drum 100 in each image forming station is a negatively chargeable photosensitive member. It is rotated in the clockwise direction indicated by an arrow mark in FIG. 1, by a photosensitive drum driving motor (unshown). To the charging device 200 in each image forming station, a voltage for charging the photosensitive drum 100 is applied from a charge voltage power source (unshown) with a preset timing.

The exposing device 300 in each image forming station exposes the photosensitive drum 100 with the use of the beam of laser light which it emits while modulating the beam according to the data of the image to be formed, which are provided by a personal computer or the like. More specifically, as the photosensitive drum 100 is rotated (in secondary scan direction), the exposing device 300 scans the uniformly charged area of the peripheral surface of the photosensitive drum 100 in the primary scan direction, with the beam of laser light, which is being turned on or off according to the data of the image to be formed. Thus, the numerous points (dots) of the charged area of the peripheral surface of the photosensitive drum 100 are exposed by the beam of laser light. As a result, an electrostatic latent image which reflects the data of the image to be formed is effected on the peripheral surface of the photosensitive drum 100. The primary scan direction is parallel to the lengthwise direction of the photosensitive drum 100 (rotational axis of photosensitive drum 100). It is perpendicular to the rotational direction of the photosensitive drum. The secondary scan direction is the direction in which the peripheral surface of the photosensitive drum 100 is moved by the rotation of the photosensitive drum 100.

The developing device 400 in each image forming station is made up of a development roller 401, a development blade 402, and a hopper 403. The development roller 401 is for developing an electrostatic latent image on the peripheral surface of the photosensitive drum 100 with the use of toner. The development blade 402 is for regulating the toner layer on the development roller 401. The hopper 403 is where toner is stored. The developer in this embodiment is such toner that is negative in intrinsic polarity. As a development bias (voltage) is applied to the development roller 401 from a development bias power source (unshown) while the development roller is rotated by a development roller driving motor (unshown), the electrostatic latent image formed on the peripheral surface of the photosensitive drum 100 is developed in reverse. The development roller 401 is a member by which the developer is borne.

The cleaning device 600 in each image forming station is for removing the residual toner and the like contaminants remaining on the peripheral surface of the photosensitive drum 100 after the primary transfer, to clean the peripheral surface of the photosensitive drum 100.

(Operation of Image Forming Apparatus)

Next, the image forming operation of the image forming apparatus A is described. Incidentally, the image forming apparatus A is structured so that an image can be formed with the use of at least one of the image forming stations Y, M, C, and K. Next, the image forming operation of this image forming apparatus A is described with reference to a case in which a full-color image is formed with the use of all of the image forming stations Y, M, C, and K.

To begin with, the photosensitive drum 100 in the yellow image forming station Y begins to be rotated. As the photosensitive drum 100 is rotated, the peripheral surface of the photosensitive drum 100 is uniformly charged by the charging device 200. Then, an electrostatic latent image is formed on the uniformly charged portion of the peripheral surface of the photosensitive drum 100 by the exposing device 300 while a development bias is being applied to the development roller 401 and the development roller 401 is rotated. As a result, the electrostatic latent image formed on the peripheral surface of the photosensitive drum 100 is developed by the development roller 401 into a yellow toner image. Then, the yellow toner image is transferred (primary transfer) onto the intermediary transfer belt 502 by the primary transfer roller 501.

Similarly, a magenta toner image is formed in the magenta image forming station M, and is transferred onto the intermediary transfer belt 502. Further, cyan and black toner images are formed in the cyan and black image forming stations C and B, respectively, and are transferred onto the intermediary transfer belt 502. The yellow, magenta, cyan, and black toner images are formed so that they are transferred in layers onto the intermediary transfer belt 502.

As the multilayer toner image formed on the intermediary transfer belt 502 is moved to the position of the secondary transfer roller 503 by the circular movement of the intermediary transfer belt 502.

Meanwhile, one of the multiple sheets 900 of recording medium in the cassette 700 is pulled out of the cassette 700 by the recording medium feeder roller 701, and is conveyed to the pair of timing rollers 702. As the sheet 900 of recording medium is conveyed to the pair of timing rollers 702, it is detected by the timing sensor 703 which is on the exit side of the pair of timing roller 702. As the sheet 900 is detected, the pair of timing roller 702 is temporarily stopped to keep the sheet 900 on standby.

The pair of timing rollers 702 send the sheet 900 into the second transfer station with the same timing as the timing with which the circular movement of the intermediary transfer belt 502 sends the toner image on the intermediary transfer belt 502 into the second transfer station 503, in which the second transfer roller 503 is present.

Then, the sheet 900 of recording medium begins to be fed into the nip between the intermediary transfer belt 502 and second transfer roller 503 while the secondary transfer roller 503 is kept pressed upon the intermediary transfer belt 502, in synchronism with the timing with which the multilayer toner image on the intermediary transfer belt 502 arrives at the nip. As the sheet 900 is conveyed through the nip, the toner image is transferred (secondary transfer) onto the sheet 900 by the secondary transfer roller 503 to which the secondary transfer bias is being applied from an electrical power source (unshown).

Thereafter, the sheet 900 of recording medium is conveyed through the fixing device 800, in which the toner image on the sheet 900 is subjected to heat and pressure, being thereby fixed to the sheet 900.

After the fixation of the toner image to the sheet 900, the sheet 900 is discharged into the delivery tray 705 by the pair of discharge rollers 704.

In each image forming station, the residual toner and the like contaminants remaining on the peripheral surface of the photosensitive drum 100 after the primary transfer of the toner image are removed by the cleaning device 600 to clean the peripheral surface of the photosensitive drum 100. As for the residual toner and the like contaminants remaining on the intermediary transfer belt 502 after the secondary transfer, they are removed by the cleaning device 504 to clean the intermediary transfer belt 502.

As is evident from the above given description of the image forming operation of the image forming apparatus A, the image forming apparatus A in this embodiment can form an image on a sheet 900 of recording medium. Further, the image forming apparatus A can form in succession multiple images on multiple sheets 900 of recording medium, one for one (continuous printing job). In either case, as the image forming apparatus A is instructed by a user through a personal computer (unshown) to perform a printing job, the apparatus A performs the printing job (image forming operation) following the instruction.

Referring again to FIG. 1, the image forming apparatus A has a control section A (Acon). The control section Acon has: a job status detecting section Amem for detecting the progression of the printing operation, the data for which are provided from the personal computer or the like; and a print counter Apri for counting the number of times the image formation sequence is repeated. Not only does the control section Acon issue ordinary image formation instructions, but also, the instructions for a toner discharge sequence (toner discharge mode: sequence control).

(Toner Discharge Sequence)

Next, the toner discharge sequence in this embodiment is described. The toner discharge sequence is carried out while no image is formed. It is such a sequence that causes toner on the development roller 401 (developing device 400) to entirely transfer onto the peripheral surface of the photosensitive drum 100, and then, causes the cleaning blade 601 to remove the toner on the peripheral surface of the photosensitive drum 100 without allowing the toner (toner image) on the peripheral surface of the photosensitive drum 100 to transfer onto the sheet 900 of recording medium. The toner discharge sequence is carried out with a preset timing. That is, as the image formation count obtained by the print counter Apri reaches a preset threshold value (image count), the image forming apparatus A is instructed by the control section Acon to carry out the toner discharge sequence. For example, if a given job is completed while the cumulative image formation count obtained by the print counter Apri is a range of 50-100, the toner discharge sequence is carried out immediately after the completion of the job. In a case of a printing job which exceeds 100 in print count, the toner discharge sequence is carried out during the recording sheet interval between the 100th sheet 900 and 101st sheet 900. Then, as soon as the toner discharge sequence is completed, the interrupted job is restarted to be continued. After the completion of each toner discharge sequence, the print counter Apri is reset to zero, and then, is made to start counting as the interrupted job is restarted.

The detail of the toner discharge sequence is as follows: The image forming apparatus A is kept in the same state as the one in which it is kept for the normal image forming sequence, and a solid rectangular toner image which is equal in size to the entirety of the peripheral surface of the development roller 401 is formed on the peripheral surface of the photosensitive drum 100 by exposing the peripheral surface of the photosensitive drum 100 with the exposing device 300. Here, the "state in which the image forming apparatus A is kept for a normal image forming sequence" means that the photosensitive drum 100 and development roller 401 are being rotated; the peripheral surface of the photosensitive drum 100 is uniformly charged; and the development bias is being applied to the development roller 401. The amount by which toner is recovered by the cleaning blade 601 from the solid rectangular toner image on the peripheral surface of the photosensitive drum 100 is controlled by the control section Acon; the control section Acon adjusts the primary transfer bias (which is applied to the primary transfer roller 501) according to the print count detected by the print counter Amem, as will be described later.

In a case where the primary transfer bias is not applied to the primary transfer roller 501 when the image forming apparatus A is operated in the toner discharge mode, the solid rectangular toner image (all the toner of which solid image is formed) is recovered by the cleaning blade 601, and therefore, the amount by which toner is recovered by the cleaning blade 601 is greater than that when the image forming apparatus A is in the normal image formation mode.

In comparison, in a case where the primary transfer bias is applied to the primary transfer roller 501 when the image forming apparatus A is operating in the toner discharge mode, the solid rectangular toner image on the peripheral surface of the photosensitive drum 100 is removed in the following manner. That is, first, the solid rectangular toner image is transferred onto the intermediary transfer belt 502, and then, is recovered from the intermediary transfer belt 502 by the cleaning device 504. Then, the toner which did not transfer from the photosensitive drum 100 onto the intermediary transfer belt 502, that is, the toner which remained on the photosensitive drum 100, is removed by the cleaning blade 601. In other words, the amount by which toner is removed from the peripheral surface of the photosensitive drum 100 by the cleaning blade 601 in the toner discharge sequence is the same as that by which toner is removed from the peripheral surface of the photosensitive drum 100 by the cleaning blade 601 in the normal image formation sequence in which a solid rectangular toner image which corresponds in size the entirety of the peripheral surface of the development roller 401 is formed.

That is, in a case where the primary transfer bias is not applied to the primary transfer roller 501 in the toner discharge sequence, the amount by which toner is recovered by the cleaning blade 601 is greater than that in a case where the primary transfer bias is applied to the primary transfer roller 501 in the toner discharge sequence, and vice versa. Therefore, the amount by which toner is recovered by the cleaning blade 601 can be controlled without changing the amount by which toner is moved out of the developing device 400.

Here, the intermediary transfer belt 502, primary transfer roller 501, primary transfer bias power source, and cleaning member 504*a* (cleaning device 504) make up the toner removing means which is capable of removing the toner on the photosensitive drum 100 before the cleaning blade 601.

(Toner Discharge Sequence)

Figure 2:
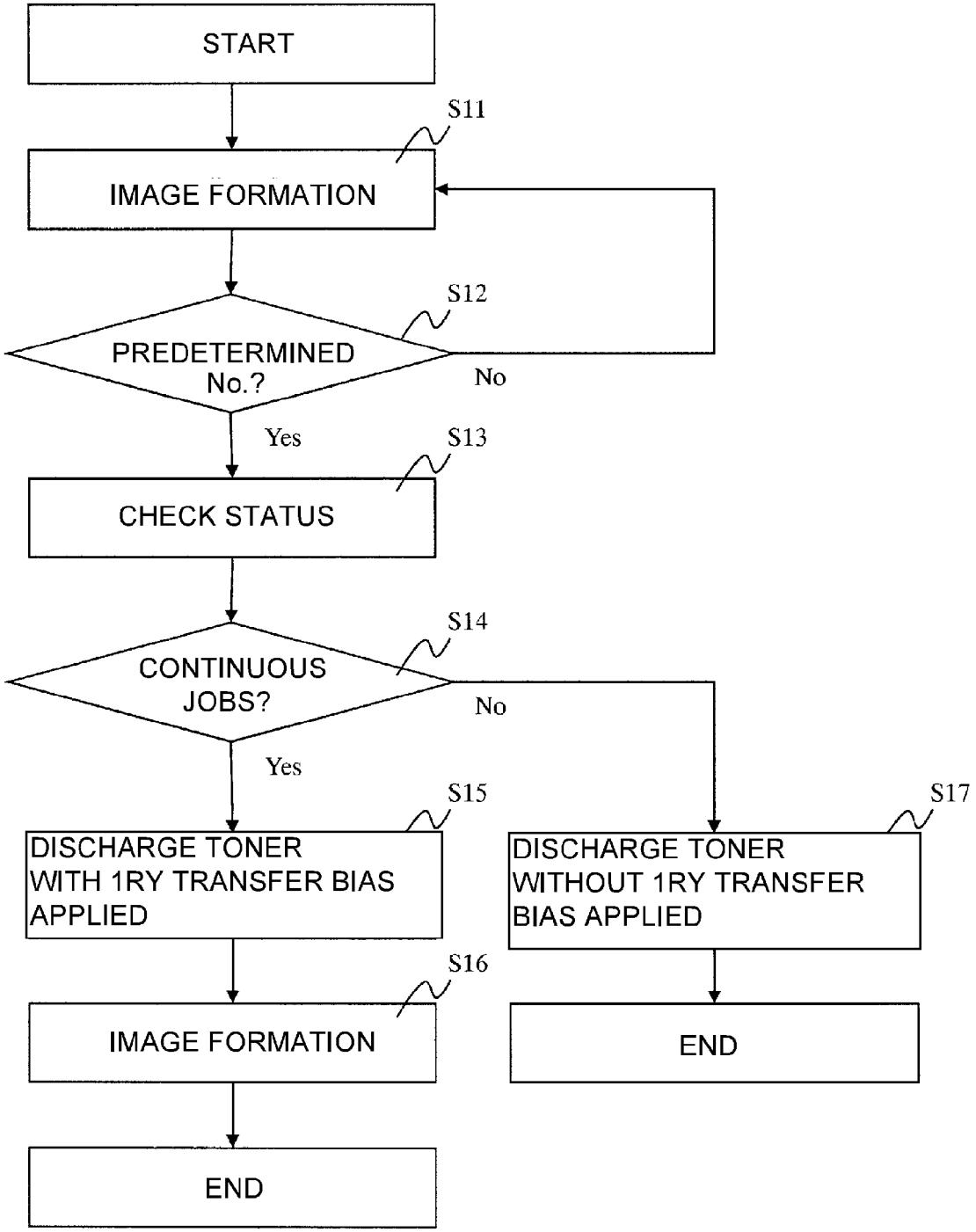
FIG. 2 is a block diagram of the toner discharge sequence carried out by the image forming apparatus in the first preferred embodiment.

Next, referring to FIG. 2, the toner discharge sequence to be carried out by the control section Acon is described. FIG. 2 is a block diagram of the toner discharge sequence in the first preferred embodiment of the present invention.

The toner discharge sequence is carried out by each of the four image forming stations. Here, however, it is described with reference to only one of the image forming stations. The toner discharge sequences to be sequentially carried out in the rest of the image forming stations, one for one, are the same as the one that is described next.

First, the normal image formation sequence is carried out (S11). Then, it is determined by the control section Acon whether or not the cumulative print count obtained by the print counter Apir has reached a preset value. If the control Acon determines that the print count has reached the preset value (S12), it determines the extent of the progression of the on-going job, through the job status detecting section Amen (S13). Then, it determines whether or not the on-going job is a continuous print job (S14). It is at this point of the job that whether or not the on-going job is a continuous print job is determined. If the control sections Acon determines that images have been consecutively formed on no less than a preset number of sheets 900 of recording medium, and there remains one or more images to be consecutively formed on a corresponding number of sheets 900 of recording medium, one for one, the control section Acon determines that the on-going job is a continuous print job.

If the control section Acon determines in S14 that the on-going job is a continuous one, it makes the image forming apparatus carry out the toner discharge sequence in the following manner. That is, after the completion of the immediately preceding image forming sequence, the on-going job is interrupted, and the toner discharge sequence (primary transfer bias is applied without stopping photosensitive drum 100) (S15: first sequence control). Then, the interrupted job is immediately restarted to continue the interrupted continuous printing job (S16).

If the control section Acon determines in S14 that the on-going job is not a continuous printing job, the control section Acon ends the printing job. Then, it restarts the rotation of the photosensitive drum 100, and causes the image forming apparatus A to carry out a toner discharge sequence without applying the primary transfer bias (S17: second sequence control). Then, it prepares the image forming apparatus A for the next job. Here, the statement that a printing job is not a continuous printing job means that the job is a very short job and requires the image forming apparatus A to output only one or two prints.

As described-above, in this embodiment, in a case where a printing job is a continuous one, a toner discharge sequence in which the primary transfer bias is applied is carried out, whereas in a case where a printing job is not a continuous one, a toner discharge sequence in which the primary transfer bias is not applied is carried out. With the use of this setup, it is possible to control the amount by which toner is recovered by the cleaning blade 601. That is, in a case where a toner discharge sequence has to be carried out between a given image formation sequence and the next image formation sequence during a continuous printing job, the toner discharge sequence in which the primary transfer bias is applied is carried out so that the amount by which toner is recovered by the cleaning blade 601 is smaller than the amount by which toner is recovered by the cleaning blade 601 in the toner discharge sequence in which the primary transfer bias is not applied. Therefore, it is unnecessary to extend the length of the rotation of the photosensitive drum 100 to increase the length of time the toner on the photosensitive drum 100 can be recovered by the cleaning blade 601 in order to prevent the problem that the image forming apparatus A outputs a defective image, more specifically, an image having unwanted fine streaks attributable to the toner particles which slipped by the cleaning blade 601. Thus, the toner discharge sequence in accordance with the present invention does not significantly add to the downtime.

A toner discharge sequence in which the primary transfer bias is applied is smaller in the amount by which toner is recovered by the cleaning blade 601 than a toner discharge sequence in which the primary transfer bias is not applied. Thus, if a toner discharge sequence in which the primary transfer bias is applied is carried out during a continuous printing job, it is possible that the cleaning blade 601 will reduce in lubricity (relative to photosensitive drum 100). In a continuous printing job, however, even if a continuous print job is small in the amount by which toner is consumed for image formation, the cleaning blade 601 continuously collects a small amount of transfer residual toner each time an image is formed on the peripheral surface of the photosensitive drum 100. Therefore, the cleaning blade 601 remains lubricated relative to the photosensitive drum 100 to a certain degree.

Further, when a toner discharge sequence begins to be carried out during a continuous printing job, toner will have collected on the cleaning blade 601 by the amount which is roughly equal to the amount by which toner is recovered by the cleaning blade 601 when a solid rectangular toner image (which corresponds in size to entirety of peripheral surface of development roller 401) is formed, that is, by the amount larger than the amount by which toner is recovered by the cleaning blade 601 in the normal image forming job (for example, job for printing document). Therefore, the amount by which toner is to be recovered by the cleaning blade 601 in order for the cleaning blade 601 to be satisfactorily lubricated relative to the photosensitive drum 100 in a toner discharge sequence which is carried out during a continuous printing job may be smaller than the amount by which toner is to be recovered by the cleaning blade 601 in order for the cleaning blade 601 to be satisfactorily lubricated relative to the photosensitive drum 100 in a toner discharge sequence to be carried out after the completion of a short printing job which yields only one or two prints.

Further, in order to minimize the length of downtime which occurs during a continuous printing job in which one or more toner discharge sequences are carried out, the length of time the photosensitive drum 100 is rotated after the completion of each toner discharge sequence has to be minimized. Therefore, if a toner discharge sequence is large in the amount by which toner is discharged, and therefore, the amount by which toner slips by the cleaning blade 601 is large, the toner having slipped by the cleaning blade 601 cannot be fully recovered. Therefore, it is possible for the image forming apparatus A to output an image having unwanted fine streaks which are attributable to the toner having slipped by the cleaning blade 601.

Therefore, the amount by which toner is recovered by the cleaning blade 601 is desired to be reasonably small (while remaining in a specific range).

On the other hand, when a toner discharge sequence is not carried out during a continuous printing job, a post-rotation process and a pre-rotation process immediately follows a toner discharge sequence. Here, "post-rotation process" means a process which is carried out immediately after the completion of a given printing job, and in which a photosensitive drum is rotated to remove electric charge from the photosensitive drum, and for the like purpose. "Pre-rotation process" is a preparatory process for image formation. In the "pre-rotation process", the amount and polarity of the voltage to be applied to the charging device 200, and the amount and polarity of the voltage to be applied to the developing device 400 are determined. Also in the "pre-rotation process", the photosensitive drum 100 is rotated. Thus, when a given printing job is not a continuous printing job, the "pre-rotation process" or "post-rotation process", are relatively long compared to the length of time spent actually for the formation of images. That is, the length of time the photosensitive drum 100 is rotated without supplying the photosensitive drum 100 with toner is relatively long. Thus, it is possible that the cleaning blade 601 is reduced in lubricity. In this embodiment, however, when a given printing job is not a continuous printing job, a toner discharge sequence in which the primary transfer bias is not applied is carried out to increase the amount by which toner is recovered by the cleaning blade 601 compared to the amount by which toner is recovered by the cleaning blade 601 in a toner discharge sequence in which the primary transfer bias is applied. Therefore, it is ensured that the cleaning blade 601 remains sufficiently lubricated. Further, a toner discharge sequence is completely independently carried out from an image forming operation. Therefore, it is possible to substantially extend the length of time the photosensitive drum 100 is to be rotated to increase the length of time for recovering the transfer residual toner on the peripheral surface of the photosensitive drum 100. Therefore, even if a certain amount of toner in a solid rectangular toner image (which corresponds in size to entirety of peripheral surface of development roller) formed in a toner discharge sequence slips by the cleaning blade 601, it can be fully recovered. Therefore, it is possible to prevent the image forming apparatus A from outputting a defective image, more specifically, an image having unwanted fine streaks which are parallel to the rotational direction of the photosensitive drum, and are attributable to the toner having slipped by the cleaning blade 601.

As described above, according to this embodiment, in a case where a toner discharge sequence is carried out during a continuous printing job, the amount by which toner is recovered by the cleaning blade 601 is reduced without changing the developing device 400 in the amount by which toner is moved out of the developing device 400, and also, without increasing the image forming apparatus A in downtime. Therefore, not only can a toner discharge sequence in this embodiment rejuvenate the toner in the developing device 400 and remove the toner on the peripheral surface of the development roller 401, but also, can ensure that the cleaning blade 601 remains sufficiently lubricated. Therefore, it can prevent the toner in the developing device 400 and the toner on the peripheral surface of the development roller 401 from reducing in quality, and also, prevent the cleaning blade 601 from buckling. Therefore, it can prevent the image forming apparatus A from outputting a defective image, the defect of which is attributable to the toner having slipped by the cleaning blade 601. Therefore, it can make the image forming apparatus A output excellent images. Incidentally, the rate at which toner is moved out of the developing device 400 in a toner discharge sequence does not need to remain strictly constant. That is, all that is necessary is that it remains roughly constant.

Embodiment 2

Figure 3:
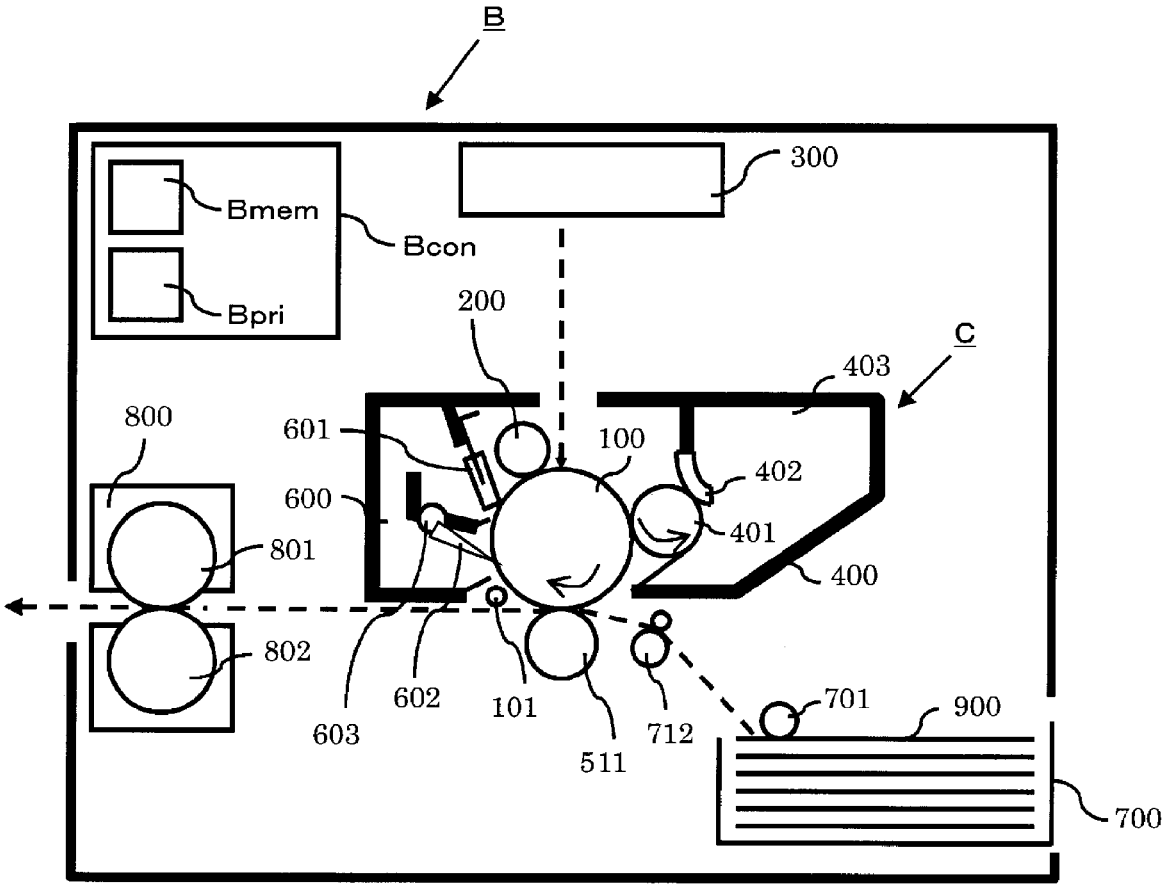
FIG. 3 is a schematic sectional view of the image forming apparatus in the second preferred embodiment of the present invention, and shows the general structure of the apparatus.

FIG. 3 is a schematic sectional view of the image forming apparatus B in the second preferred embodiment of the present invention. It shows the general structure of the apparatus B. Next, the image forming apparatus B, which is in accordance with the present invention, is described. The first embodiment was described with reference to the image forming apparatus A which was a full-color image forming apparatus of the so-called tandem type and had the four image forming stations. This embodiment, however, is described with reference to the image forming apparatus B which has only one image forming station. The image forming apparatus B has only one photosensitive drum 100, which is in the center of the main assembly of the apparatus B. The structural components of the image forming apparatus B, which are similar in structure to the counterparts of the image forming apparatus A in the first embodiment are given the same referential codes as those given to the counterparts, and are not going to be described.

(Image Forming Apparatus)

This image forming apparatus has only one photosensitive drum 100 as an image bearing member on which an electrostatic latent image is formed. The photosensitive drum 100 is in the center of the main assembly of the image forming apparatus B. The apparatus B has also a charging device 200, an exposing device 300, a developing device 400, a transfer roller 511, a cleaning device 600, a charge removal lamp 101, a toner recovery scraper 602, a fixing device 800, and a cassette 700 (toner supply cassette), which are in the adjacencies of the peripheral surface of the photosensitive drum 100. The transfer roller 511 is the transferring means for transferring a toner image on the peripheral surface of the photosensitive drum 100 onto a sheet 900 of recording medium. That is, as an electrostatic latent image formed on the peripheral surface of the photosensitive drum 100 is developed by the developing device 400 into a visible image, that is, an image formed of toner, the transfer roller 511 transfers the toner image from the photosensitive drum 100 onto a sheet 900 of recording medium in the transfer station (transfer nip) between the photosensitive drum 100 and transfer roller 511. The cleaning device 600 is for removing the contaminants such as transfer residual toner on the peripheral surface of the photosensitive drum 100 with the use of its cleaning blade 601 to clean the peripheral surface of the photosensitive drum 100. The charge removal lamp 101 is for removing the surface potential from the peripheral surface of the photosensitive drum 100 after the transfer of the toner image.

The toner removal scraper 602 is the second cleaning member. It is for removing (recovering) the solid rectangular toner image formed on the peripheral surface of the photosensitive drum 100, in a toner discharge sequence. It can be placed in contact with, or separated from, the peripheral surface of the photosensitive drum 100 by a scraper moving mechanism 603 for changing the toner removal scraper 602 in attitude. The toner recovery scraper 602 and scraper moving mechanism 603 make up a toner removing (recovering) means which can remove the toner on the peripheral surface of the photosensitive drum 100 before the cleaning blade 601. That is, the image forming apparatus B is structured so that in terms of the moving direction of the peripheral surface of the photosensitive drum 100, the point at which this toner removing means removes the toner discharged (transferred) onto the peripheral surface of the photosensitive drum 100 in a toner discharge sequence is on the upstream side of the point at which the cleaning blade 601 removes the toner.

The photosensitive drum 100, charging device 200, developing device 400, and cleaning device 600 are integrally placed in a cartridge, making up a process cartridge, which is removably mountable in the main assembly of the image forming apparatus B.

To the transfer roller 511, a transfer bias for transferring the toner image on the peripheral surface of the photosensitive drum 100 onto a sheet 900 of recording medium is applied from a transfer bias power source (unshown) with a preset timing. During the toner discharge sequence in this embodiment, which will be described later, the transfer roller 511 is separated from the photosensitive drum 100 with a preset timing, and is kept separated thereafter, by a transfer roller moving mechanism (unshown).

The sheets 900 of recording medium stored in layers in the cassette 700 are sent one by one by a recording medium feeding roller 701 to a pair of registration rollers 712 in synchronism with the formation of a visible image on the peripheral surface of the photosensitive drum 100. Then, each sheet 900 of recording medium is conveyed to the transfer station between the photosensitive drum 100 and transfer roller 511 with such a timing that the leading edge of the visible image on the peripheral surface of the photosensitive drum 100 arrives at the transfer station at the same time as the time at which the leading edge of the image bearing area of the sheet 900 of recording medium arrives at the transfer station. Then, the sheet 900 is conveyed through the transfer station while positive bias is applied between the transfer roller 511 and photosensitive drum 100. As a result, the visible image on the peripheral surface of the photosensitive drum 100 is transferred onto the sheet 900 of recording medium. After the transfer of the visible image onto the sheet 900, the sheet 900 and the visible image thereon are conveyed through the fixing device 800 while being subjected to heat and pressure. Consequently, the visible image is fixed to the sheet 900.

The toner recovery scraper 602 is for recovering the solid rectangular toner image formed on the peripheral surface of the photosensitive drum 100 during the toner discharge sequence. The toner recovery scraper 602 in this embodiment is formed of a PET sheet. It is placed in contact with, or separated from, the peripheral surface of the photosensitive drum 100 by a mechanism for moving the toner recovery scraper 602, in the toner discharge sequence. As it is placed in contact with the peripheral surface of the photosensitive drum 100, it removes the solid rectangular toner image from the peripheral surface of the photosensitive drum 100, and stores the removed toner (image) in the cleaning device 600. In terms of the rotational direction of the photosensitive drum 100, the point of contact between the toner recovery scraper 602 and the peripheral surface of the photosensitive drum 100 is on the downstream side of the transfer station between the photosensitive drum 100 and transfer roller 511, and is on the upstream side of the cleaning position of the cleaning blade 601, that is, on the upstream side of the point of contact between the cleaning blade 602 and the peripheral surface of the photosensitive drum 100.

It is not mandatory that the toner recovery scraper 602 completely removes the solid rectangular toner image formed on the peripheral surface of the photosensitive drum 100 to be discarded, in a toner discharge sequence. That is, all that is required of the toner recovery scraper 602 is to scrape away the solid rectangular toner image to be discarded, by an amount large enough to make the amount by which toner remains on the immediately downstream side of the peripheral surface of the photosensitive drum 100 relative to the toner recovery scraper 602 roughly the same as the amount by which toner remains on the peripheral surface of the photosensitive drum 100 after the toner image transfer in the normal image formation sequence. The residual toner on the peripheral surface of the photosensitive drum 100, which is from the solid rectangular toner image formed in the toner discharge sequence, is removed from the peripheral surface of the photosensitive drum 100 by the cleaning blade 601.

Not only can the image forming apparatus B perform an image forming operation in which an image is formed on a single sheet 900 of recording medium, but also, an image forming operation in which multiples images are consecutively formed on the multiple sheets 900 of recording medium, one for one. That is, as the apparatus B receives a printing job command from a user through a personal computer (unshown) or the like, it forms an image or images following the commands, whether the printing job is for outputting only a single print (image) or continuously outputting multiple prints (images).

Referring to FIG. 3, the image forming apparatus B has a control section Bcon (controlling means). The control section Bcon has: a job status detecting section Bmem for detecting the progression of the printing operation, the data for which are provided from the personal computer or the like; and a print counter Bpri for counting the number of times the image formation sequence is repeated. Not only does the control section Bcon issues ordinary image formation instructions, but also, the instructions for the toner discharge sequence, which will be described later.

(Toner Discharge Sequence)

Next, the toner discharge sequence in this embodiment is described. The toner discharge sequence is carried out while no image is formed. Further, the toner discharge sequence is carried out with a preset timing; as the image formation count obtained by the print counter Bpri reaches a preset threshold value (image count), the image forming apparatus B is instructed by the control section Bcon to carry out the toner discharge sequence. The details of the toner discharge timing are similar to those in the first embodiment, and therefore, are not described here.

The toner discharge sequence in this embodiment is as follows: The image forming apparatus B is kept in the same state as the one in which it is kept for a normal image forming sequence, and a solid rectangular toner image which corresponds in size and position to the entirety of the peripheral surface of the development roller 401 is formed on the peripheral surface of the photosensitive drum 100 by exposing the entirety of the peripheral surface of the photosensitive drum 100 with the exposing device 300. Here, the "state in which the image forming apparatus B is kept for the normal image forming sequence" means the state in which the photosensitive drum 100 and development roller 401 are being rotated; the peripheral surface of the photosensitive drum 100 is uniformly charged; and the development bias is being applied to the development roller 401.

During the toner discharge sequence in this embodiment, the transfer roller 511 is kept separated from the photosensitive drum 100. The amount by which toner is recovered by the cleaning blade 601 from the solid rectangular toner image on the peripheral surface of the photosensitive drum 100 is controlled by the control section Bcon; the control section Bcon controls the amount by which toner is recovered by the toner recovery scraper 602 from the solid rectangular toner image on the peripheral surface of the photosensitive drum 100 by placing the toner recovery scraper 602 in contact with the peripheral surface of the photosensitive drum 100, or separating the scraper 602 from the peripheral surface of the photosensitive drum 100, according to the progression of the on-going image forming operation, which is detected by the job status detecting means Bmem, as will be described later.

In a case where the toner recovery scraper 602 is not placed in contact with the peripheral surface of the photosensitive drum 100, the solid rectangular toner image (all toner of which solid image is formed) is recovered by the cleaning blade 601, and therefore, the amount by which toner is recovered by the cleaning blade 601 is greater than that when the image forming apparatus B is in the normal image formation mode.

In comparison, in a case where the toner recovery scraper 602 is placed in contact with the peripheral surface of the photosensitive drum 100, the solid rectangular toner image on the peripheral surface of the photosensitive drum 100 is removed in the following manner. That is, first, most of the solid rectangular toner image is removed from the peripheral surface of the photosensitive drum 100 by the toner recovery scraper 602, and is recovered into the cleaning device 600. Then, the toner which was not removed from the peripheral surface of the photosensitive drum 100 by the toner recovery scraper 602, that is, the toner which remained on the photosensitive drum 100, is removed by the cleaning blade 601. In other words, in a case where the toner recovery scraper 602 is not activated (not placed in contact with peripheral surface of photosensitive drum 100) during the toner discharge sequence, the amount by which toner is recovered by the cleaning blade 601 is greater than that in a case where the toner recovery scraper 602 is placed in contact with the peripheral surface of the photosensitive drum 100 during the toner discharge sequence. In other words, by controlling, with the use of the control section Bcon, the length of time the toner recovery scraper 602 is kept in contact with the peripheral surface of the photosensitive drum 100, the amount by which toner is recovered by the cleaning blade 601 can be controlled without changing the amount by which toner is moved out of the developing device 400.

(Toner Discharge Sequence)

Figure 4:
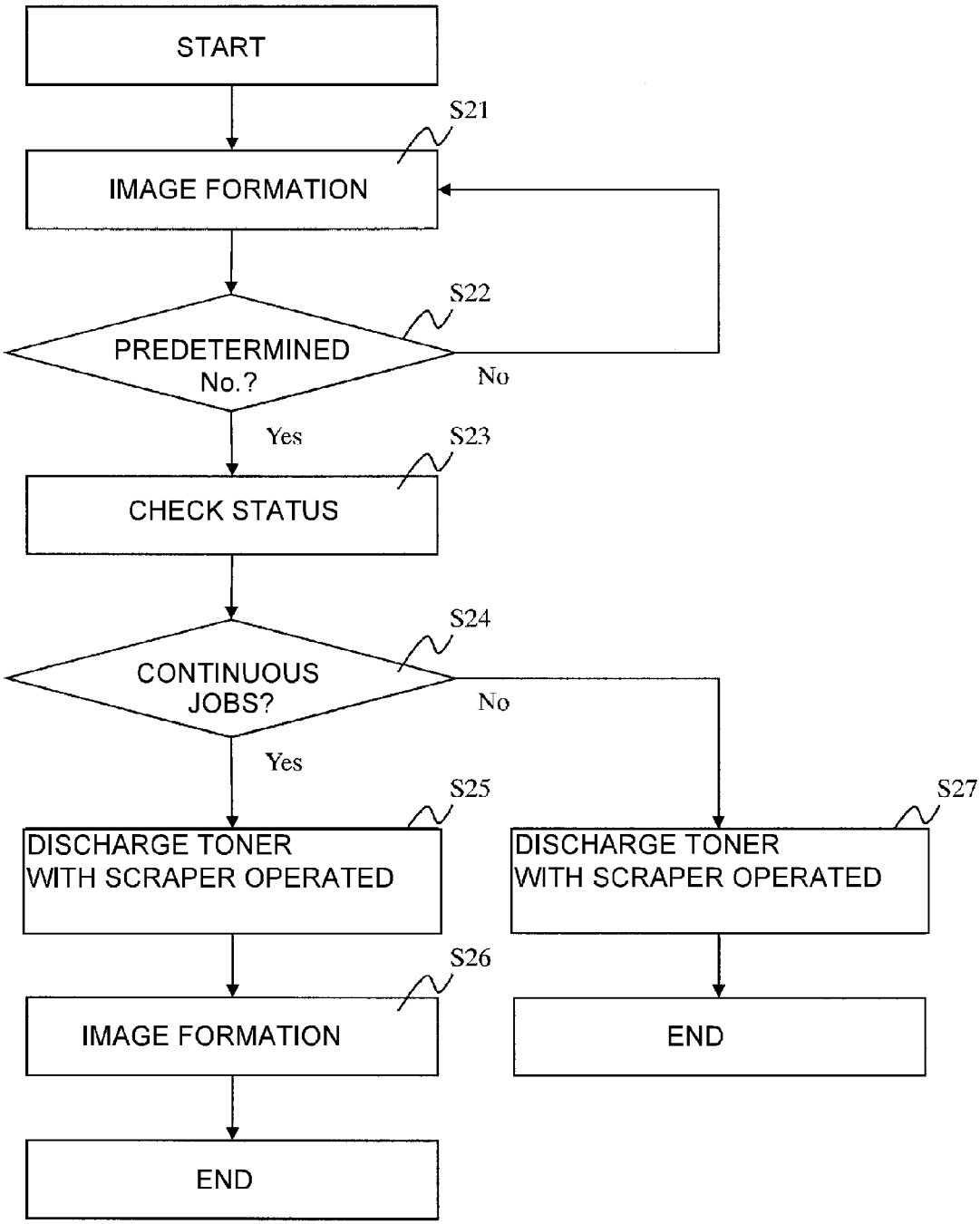
FIG. 4 is a block diagram of the toner discharge sequence carried out by the image forming apparatus in the second preferred embodiment.

Next, referring to FIG. 4, the toner discharge sequence to be carried out by the control section Bcon is described. FIG. 4 is a block diagram of the toner discharge sequence in the second preferred embodiment of the present invention.

First, the normal image formation sequence is carried out (S21). Then, it is determined whether or not the cumulative print count obtained by the print counter Bpir has reached a preset value. If it is determined that the print count reached the preset value (S22), the control section Bcon detects, through the job status detecting means Bmem, the extent of the progression of the on-going job (S23). Then, the control section Bcon determines whether or not the on-going job is a continuous print job (S24). It is at this point of the job that whether or not the on-going job is a continuous print job is determined. If the control section Bcon determines that images have been consecutively formed on no less than a preset number of sheets of recording medium, and there remains one or more images to be consecutively formed on a corresponding number of sheets of recording medium, one for one, the control section Bcon determines that the on-going job is a continuous print job.

If the control section Bcon determines in S24 that the on-going job is a continuous one, it makes the apparatus B perform the toner discharge sequence in the following manner. That is, after the completion of the immediately preceding image forming sequence, the on-going job is interrupted, and the toner discharge sequence (in which toner recovery scraper 602 is placed in contact with peripheral surface of photosensitive drum 100) is carried out without stopping photosensitive drum 100) (S25: first sequence control). Then, the interrupted job is immediately restarted to continue the interrupted continuous printing job (S26).

If the control section Bcon determines in S24 that the on-going job is not a continuous printing job, the control section Bcon ends the printing job. Then, it restarts the rotation of the photosensitive drum 100, and causes the image forming apparatus B to carry out a toner discharge sequence without placing the toner recovery scraper 602 in contact with the peripheral surface of the photosensitive drum 100 (S27: second sequence control). Then, it prepares the image forming apparatus B for the next job.

As described above, in this embodiment, in a case where a printing job is a continuous one, the toner discharge sequence in which the toner recovery scraper 602 is placed in contact with the peripheral surface of the photosensitive drum 100 is carried out, whereas in a case where a printing job is not a continuous one, the toner discharge sequence in which the toner recovery scraper 602 is not placed in contact with the peripheral surface of the photosensitive drum 100 is carried out. With the use of this setup, it is possible to control the amount by which toner is recovered by the cleaning blade 601. That is, in a case where a toner discharge sequence has to be carried out between a given image formation sequence and the next image formation sequence during a continuous printing job, the amount by which toner is recovered by the cleaning blade 601 in the toner discharge sequence in which the toner recovery scraper 602 is placed in contact with the peripheral surface of the photosensitive drum 100 can be made smaller than the amount by which toner is recovered by the cleaning blade 601 in the toner discharge sequence in which the toner recovery scraper 602 is not placed in contact with the peripheral surface of the photosensitive drum 100. Therefore, it is unnecessary to extend the length of time the photosensitive drum 100 is rotated to increase the length of time the toner on the photosensitive drum 100 can be recovered by the cleaning blade 601 in order to prevent the problem that the image forming apparatus B outputs a defective image, more specifically, an image having unwanted fine streaks attributable to the toner particles which slipped by the cleaning blade 601.

In the case of a continuous printing job, the toner discharge sequence in which the toner recovery scraper 602 is placed in contact with the photosensitive drum 100 is carried out. Therefore, the amount by which toner is recovered by the cleaning blade 601 is smaller. Thus, it is possible for the image forming apparatus B to reduce the lubricity between the photosensitive drum 100 and cleaning blade 601. In a continuous printing job, however, even if a substantial number of images, each of which is small in the amount of toner consumption for its formation, are continuously formed, the transfer residual toner is recovered by the cleaning blade 601, although only by a small amount. Thus, the cleaning blade 601 remains lubricated relative to the photosensitive drum 100 to a certain degree. Further, when the toner discharge sequence begins to be carried out during a continuous printing job, toner will have been recovered by the cleaning blade 601 by roughly the same amount as the amount by which the transfer residual toner is recovered during the formation of a solid image, that is, the amount greater than the amount by which toner is recovered during the normal image formation (for example, job for printing document). Therefore, the cleaning blade 601 can be properly lubricated by a smaller amount of toner than the amount of toner which is necessary to properly lubricate the cleaning blade 601 when a substantial number of printing jobs, each of which is for printing one or two images (prints), are continuously carried out.

Also in a case where the toner discharge sequence is carried out during a continuous printing job, the length of time the photosensitive drum is rotated immediately after the completion of the toner discharge sequence has to be minimized in order to minimize the downtime. Therefore, if the amount by which toner is discharged in the toner discharge sequence is large, and therefore, the amount by which toner slips by the cleaning blade is large, the toner having slipped by the cleaning blade cannot be fully recovered. Therefore, it is possible for the image forming apparatus to output defective images, that is, images having unwanted fine streaks which are parallel to the rotation direction of the photosensitive drum and are attributable to the toner having slipped by the cleaning blade. Therefore, it is effective to reduce the amount of toner which is to be recovered by the cleaning blade during the toner discharge sequence.

On the other hand, in a case where the toner discharge sequence is not carried out during a continuous printing job, the post-rotation process and the pre-rotation process come immediately after the completion of the toner discharge sequence. Therefore, in a case where a given printing job is not a continuous printing job, the "pre-rotation process" or "post-rotation process", are relatively long compared to the length of time spent actually for the formation of images. That is, the length of time the photosensitive drum 100 is rotated without supplying the photosensitive drum 100 with toner is relatively long. Thus, it is possible that the cleaning blade 601 is reduced in lubricity. In this embodiment, however, when a given printing job is not a continuous printing job, a toner discharge sequence in which the toner recovery scraper 602 is not placed in contact with the photosensitive drum 100 is carried out. Therefore, the amount by which toner is recovered by the cleaning blade 601 is larger compared to the amount by which toner is recovered by the cleaning blade 601 in a toner discharge sequence in which the toner recovery scraper 602 is placed in contact with the photosensitive drum 100. Therefore, it is ensured that the cleaning blade 601 remains sufficiently lubricated.

Further, the toner discharge sequence is completely independently carried out from an image forming operation. Therefore, it is possible to substantially extend the length of time the photosensitive drum 100 is to be rotated to increase the length of time for recovering the transfer residual toner on the peripheral surface of the photosensitive drum 100. Therefore, even if a certain amount of toner in a solid rectangular toner image (which corresponds in size to entirety of peripheral surface of development roller) formed in a toner discharge sequence slips by the cleaning blade 601, it can be fully recovered. Therefore, it is possible to prevent the image forming apparatus B from outputting a defective image, more specifically, an image having unwanted fine streaks which are parallel to the rotational direction of the photosensitive drum, and are attributable to the toner having slipped by the cleaning blade 601.

As described above, this embodiment can provide the effects which are similar to those which can be provided by the first embodiment.

In the first and second preferred embodiments described above, the toner discharge sequence was carried out with a preset timing, that is, as the cumulative print count reached a preset value. However, the timing with which the toner discharge sequence is to be carried out may be when the cumulative length of time the development roller 401 or photosensitive drum 100 has been rotated, or the cumulative number of rotations of the developing device 400 or photosensitive drum 100, reaches a preset value, or the amount of toner in the developing device 400, has reduced to a preset value. That is, all that is important here is that the toner in the developing device 400 is rejuvenated, and the cleaning blade 601 is kept sufficiently lubricated. Therefore, the timing with which the toner discharge sequence is to be carried out does not need to be limited to that in the first embodiment, that is, when the cumulative image formation count reaches a preset value. Further, in the first and second embodiments, it was during the toner discharge sequence that the means for removing toner was activated. However, the timing with which the toner removing means is to be activated does not need to be limited to during the toner discharge sequence. That is, the toner removing means may be activated whenever it becomes necessary for toner to be removed.

Further, in the first embodiment, when a printing job was not a continuous one, the toner discharge sequence in which the primary transfer bias is not applied was carried out. In the second embodiment, when a printing job was not a continuous one, the toner discharge sequence in which toner recovery scraper 602 is not placed in contact with the peripheral surface of the photosensitive drum 100 was carried out. However, the first and second embodiments are not intended to limit the present invention in scope. That is, the gist of the present invention is that the amount by which toner is allowed to reach the cleaning blade during a continuous printing job is made different from the amount by which toner is allowed to reach the cleaning blade during a noncontinuous printing job (former is made smaller than latter). In other words, even in a noncontinuous printing job, the toner discharge sequence in which the primary transfer bias is applied (or toner recovery scraper 602 is placed in contact with peripheral surface of photosensitive drum 100) may be carried out to remove a part of the body of toner on the peripheral surface of the photosensitive drum 100, as long as the amount by which toner is allowed to reach the cleaning blade 601 is changed as described above.

Further, in the toner discharge sequences in the first and second embodiments, a solid rectangular toner image which corresponds in size and shape to the entirety of the peripheral surface of the development roller was formed on the peripheral surface of the photosensitive drum 100 by exposing the peripheral surface of the photosensitive drum 100 in the pattern of the solid rectangular image with the exposing device 300. However, the solid rectangular image may be formed by applying development bias to the development roller 401 without applying bias to the charging device 200. What is important here is that it is ensured that the toner in the developing device 400 is rejuvenated, and the cleaning blade 601 is kept properly lubricated. That is, the means for forming the solid rectangular toner image in a toner discharge sequence does not need to be limited to the exposing apparatus 300.

In the second embodiment described above, the amount by which toner is recovered by the cleaning blade 601 during the toner discharge sequence was controlled with the use of the toner recovery scraper 602. However, a fur brush or a sponge roller may be employed to recover the solid rectangular toner image on the peripheral surface of the photosensitive drum 100. In a case where a fur brush or a sponge roller is used as the means for recovering the solid rectangular toner image on the peripheral surface of the photosensitive drum 100, the image forming apparatus B is desired to be structured so that the fur brush or sponge roller can be controlled in their rotational direction and the bias to be applied to them. In essence, all that is necessary is that the amount by which toner is recovered by the toner recovery scraper 602 can be controlled. In other words, the choice of the toner removing means does not need to be limited to the toner recovery scraper 602.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 228686/2010 and 195387/2011 filed Oct. 8, 2010 and Sep. 7, 2011, respectively, which are hereby incorporated by reference.

What is claimed is:

1. An image forming apparatus comprising:

an image bearing member for carrying a developed image;

a developer carrying member for carrying a developer to be supplied to said image bearing member;

a cleaning blade for removing the developer from said image bearing member;

control means for executing, at predetermined timing during a non-image-formation period, sequence controls for moving a developer from said developer carrying member to said image bearing member and removing a developer from said image bearing member by said cleaning blade;

removing means capable of removing the developer at a position before the developer, moved to said image bearing member by the sequence control, reaches said cleaning blade, wherein the sequence controls includes a first sequence control and a second sequence control, and when an image forming operation is continuously carried out on a predetermined number of recording materials, and the predetermined timing comes in a state that there still remains recording material on which the image forming operation is to be effected, said control means effects a first sequence control, and wherein when the predetermined timing comes in a state that there does not remain recording material on which the image forming operation is to be effected, said control means effects a second sequence control, and wherein an amount of the developer removed by said cleaning blade is controlled to be smaller in the first sequence control than in the second sequence control.

2. An apparatus according to claim 1, further comprising:

transferring means for transferring the developed image, wherein the developed image formed on said image bearing member is first transferred onto an intermediary transfer member by said transferring means, and then is transferred onto the recording material;

voltage applying means for applying a voltage to said transferring means to transfer the developed image from said image bearing member onto said intermediary transfer member; and a cleaning member for removing the developer from said intermediary transfer member, wherein said removing means includes said intermediary transfer member, said transferring means, said voltage applying means and said cleaning member, and said control means changes the amount of the developer removed from said image bearing member.

3. An apparatus according to claim 1, further comprising a cleaning member, movable toward and away from said image bearing member, for removing the developer from said image bearing member by contacting said image bearing member in a position downstream of a transfer position where the developed image is transferred onto the recording material and upstream of a cleaning position where the developer is removed from said image bearing member by said cleaning blade, with respect to a rotational moving direction of said image bearing member, and moving means for moving said cleaning member toward and away from said image bearing member, wherein said removing means includes said cleaning member and said moving means, and wherein said control means change the amount of the developer removed from said image bearing member.

4. An apparatus according to claim 1, wherein a plurality of such developer carrying members are provided to form a color image.

* * * * *